US011364587B2

(12) United States Patent
Thayer et al.

(10) Patent No.: US 11,364,587 B2
(45) Date of Patent: Jun. 21, 2022

(54) FLOW DIRECTORS AND SHIELDS FOR ABRASIVE FLOW MACHINING OF INTERNAL PASSAGES

(71) Applicant: UNITED TECHNOLOGIES CORPORATION, Farmington, CT (US)

(72) Inventors: Henry H. Thayer, Wethersfield, CT (US); Wendell V. Twelves, Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 952 days.

(21) Appl. No.: 15/957,857

(22) Filed: Apr. 19, 2018

(65) Prior Publication Data

US 2019/0321933 A1 Oct. 24, 2019

(51) Int. Cl.

| | |
|---|---|
| ***B24B 31/00*** | (2006.01) |
| ***B24B 31/12*** | (2006.01) |
| ***B24C 3/32*** | (2006.01) |
| ***B24B 5/40*** | (2006.01) |

(52) U.S. Cl.

CPC ..... *B24B 31/006* (2013.01); *B24B 5/40* (2013.01); *B24B 31/12* (2013.01); *B24C 3/327* (2013.01)

(58) Field of Classification Search

CPC ..... B24B 31/006; B24B 31/12; B24B 31/116; B24B 5/40; B24B 19/14; B24C 3/325; B24C 3/327

USPC ..... 451/29, 36, 61, 440, 462

See application file for complete search history.

(56) References Cited

U.S. PATENT DOCUMENTS

| | | | | |
|---|---|---|---|---|
| 1,916,267 | A * | 7/1933 | Hutto | B24B 33/022 451/155 |
| 2,497,021 | A | 2/1950 | Sterns | |
| 4,417,421 | A | 11/1983 | Akagi et al. | |
| 5,307,661 | A * | 5/1994 | Fink | B24C 3/325 376/249 |
| 5,341,602 | A | 8/1994 | Foley | |
| 5,522,760 | A * | 6/1996 | Patel | B24C 1/083 451/102 |
| 6,047,714 | A * | 4/2000 | Akazawa | B08B 9/043 134/22.12 |
| 6,276,018 | B1 * | 8/2001 | Leiman | F41A 29/02 15/104.095 |
| 7,044,842 | B2 | 5/2006 | Rhoades | |
| 7,390,241 | B2 | 6/2008 | Kajita | |
| 8,585,464 | B2 * | 11/2013 | Chilson | B24B 37/02 451/51 |
| 9,550,267 | B2 | 1/2017 | Beckman et al. | |
| 2003/0027495 | A1 * | 2/2003 | Shaw | B24C 1/04 451/29 |

(Continued)

*Primary Examiner* — Monica S Carter
*Assistant Examiner* — Marcel T Dion
(74) *Attorney, Agent, or Firm* — Snell & Wilmer L.L.P.

(57) ABSTRACT

An insert apparatus for protecting a curved inner surface within a passageway from abrasion during an abrasive machining operation is disclosed. In various embodiments, the insert apparatus includes a shield having a shell shaped to match a curved portion of the curved inner surface of the passageway and a shaft having a first end connected to the shell and a second end connected to a member configured to maintain the shaft within the passageway and the shell positioned against the curved inner surface during the abrasive machining operation.

8 Claims, 5 Drawing Sheets

(56) References Cited

U.S. PATENT DOCUMENTS

| | | | | |
|---|---|---|---|---|
| 2003/0087588 | A1* | 5/2003 | Rhoades | B24B 31/116 451/36 |
| 2005/0148287 | A1* | 7/2005 | Moeller | F01D 5/005 451/6 |
| 2016/0082565 | A1 | 3/2016 | Kenda et al. | |
| 2016/0228929 | A1 | 8/2016 | Williamson et al. | |
| 2017/0144382 | A1* | 5/2017 | Ott | B24B 5/06 |
| 2017/0197284 | A1 | 7/2017 | Twelves, Jr. et al. | |
| 2017/0361418 | A1 | 12/2017 | Twelves et al. | |
| 2019/0134779 | A1* | 5/2019 | Kawasumi | B24C 1/08 |
| 2019/0217445 | A1* | 7/2019 | Kawahara | B24D 18/009 |

* cited by examiner

FLOW DIRECTORS AND SHIELDS FOR ABRASIVE FLOW MACHINING OF INTERNAL PASSAGES

FIELD

The present disclosure relates generally to methods of smoothing or finishing internal passageways of additively manufactured components and, more particularly, to methods and apparatus in which shaped inserts are positioned within the internal passageways to direct or divert an abrasive media toward or away from various portions of the internal passageways undergoing smoothing or finishing.

BACKGROUND

Fabrication processes such as additive manufacturing enable fabrication of article geometries that are difficult or otherwise impossible to make by other fabrication techniques. For example, components in gas turbine engines may include internal passages for conveying coolants or lubricants. Additive manufacturing and other advances permit such passages to be formed having complex geometries exhibiting various degrees of curvature. However, due to the additive manufacturing process, and even in other fabrication processes, the surfaces of these passages can be rough following the fabrication process. If left in the final component, this surface roughness has the potential to interfere with fluid flow through the passageways.

Abrasive machining is a technique used to smooth surface roughness on the inner surfaces of conduits or passageways in additively manufactured components. The technique involves forcing an abrasive media through the conduits or passageways to abrade or wear away the surface roughness on the inner surfaces. In some instances, however, non-uniform abrasion of the inner surfaces may result, particularly within regions where the conduits or passageways exhibit curvature. As disclosed herein, shaped inserts may be used to tailor the flow of abrasive material toward or away from specific portions of internal passageways undergoing abrasive machining.

SUMMARY

An insert apparatus for protecting a curved inner surface within a passageway from abrasion during an abrasive machining operation is disclosed. In various embodiments, the apparatus includes a shield having a shell shaped to match a curved portion of the curved inner surface of the passageway and a shaft having a first end connected to the shell and a second end connected to a member configured to maintain the shaft within the passageway and the shell positioned against the curved inner surface during the abrasive machining operation.

In various embodiments, the shield is pivotally connected to the first end of the shaft by a pin. In various embodiments, the member is a disc configured for positioning proximate one of an inlet and an exit of the passageway. In various embodiments, the disc includes one or more apertures extending through the disc and configured to convey an abrasive media from a pump to the passageway. In various embodiments, the shell is configured for insertion into a straight section of the passageway prior to being positioned against the curved inner surface. In various embodiments, the shell includes a heel configured to wrap around the shaft during insertion of the shell into the straight section of the passageway. In various embodiments, the heel includes a cutout portion configured to receive the shaft during insertion of the shell into the straight section of the passageway. In various embodiments, the apparatus further includes one or more radially extending wings positioned on the shaft intermediate the first end and the second end. In various embodiments, the curved inner surface defines a 90-degree segment of the passageway.

An insert apparatus for smoothing an inner surface within a passageway during an abrasive machining operation is disclosed. In various embodiments, the apparatus includes a shaft having a first end and a second end, the first end connected to a member configured to maintain the shaft within the passageway and an auger positioned along a length of the shaft from the first end toward the second end, the auger comprising one or more vanes extending in helical fashion along the length of the shaft. One or more channels between the shaft and the inner surface, configured to transport an abrasive media within the passageway, are formed by the one or more helical vanes.

In various embodiments, the passageway is configured to receive a flow of the abrasive media during the abrasive machining operation. In various embodiments, the member is a disc configured for positioning proximate one of an inlet and an exit of the passageway. In various embodiments, the disc includes one or more apertures extending through the disc and configured to convey the abrasive media from a pump to the passageway. In various embodiments, the disc and the auger are configured to rotate with respect to the passageway. In various embodiments, the passageway is curved and the shaft and the auger comprise a flexible material.

An insert apparatus for smoothing an inner surface within a passageway, during an abrasive machining operation, is disclosed. In various embodiments, the apparatus includes a first restriction member configured for reciprocal motion along an axis of the passageway, the first restriction member defining a peak disposed proximate the inner surface and a trough proximate the axis and a rotary mechanism configured to reciprocally translate the first restriction member along the axis of the passageway, the first restriction member causing an abrasive media to be reciprocally translated along the axis and against the inner surface.

In various embodiments, the apparatus further includes a second restriction member positioned proximate the first restriction member and a pocket disposed between the first restriction member and the second restriction member, the pocket configured to reciprocally translate the abrasive media along the axis and against the inner surface. In various embodiments, the rotary mechanism includes a crankshaft and a connecting rod disposed between the crankshaft the first restriction member. In various embodiments, the passageway is configured to receive a flow of the abrasive media during the abrasive machining operation. In various embodiments, the peak and the inner surface are spaced by a constriction distance.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1:
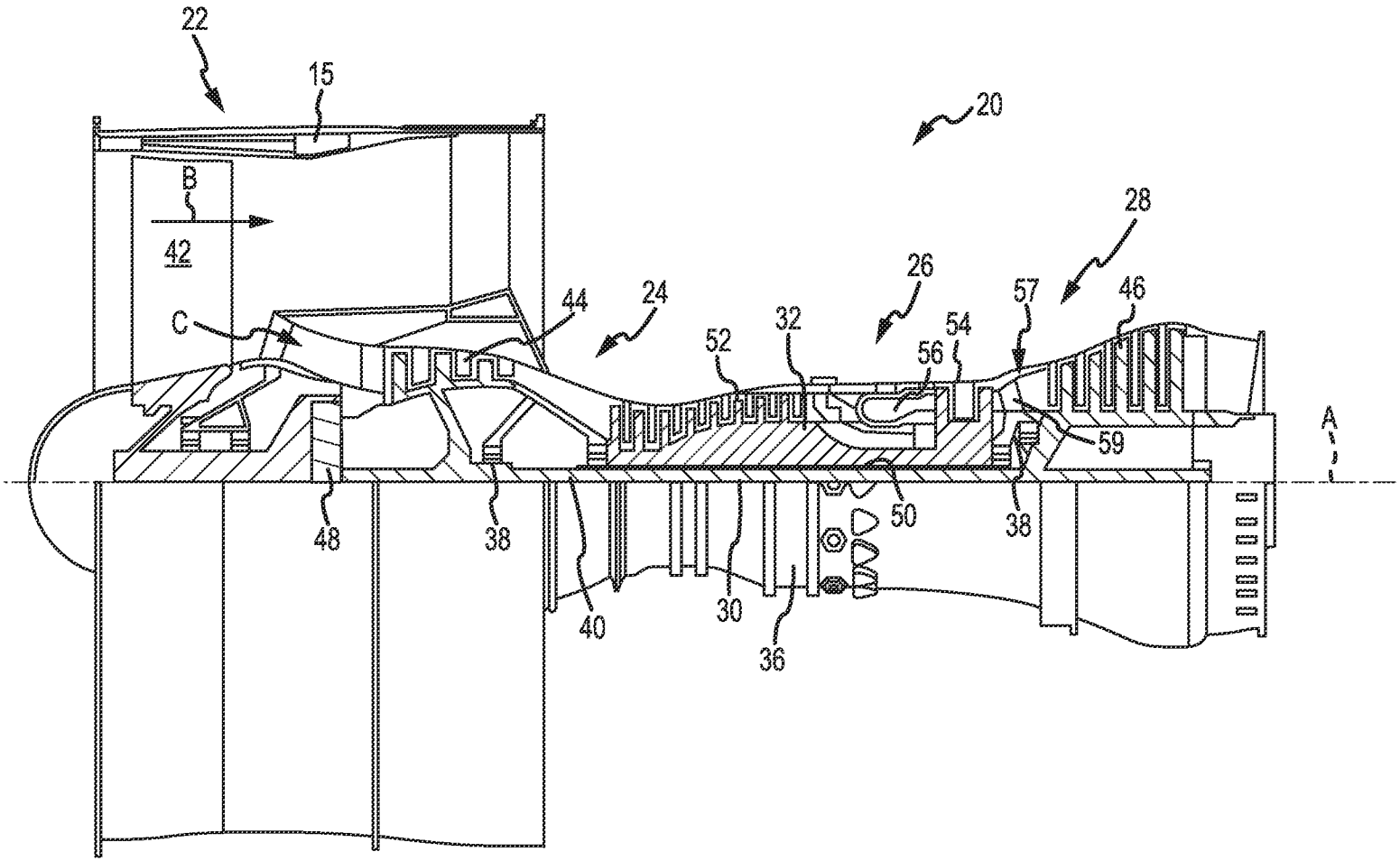
FIG. 1 is a cross sectional schematic view of a gas turbine engine, in accordance with various embodiments.

Referring now to the drawings, FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a primary or core flow path C for compression and communication into the combustor section 26 and then expansion through the turbine section 28. Although depicted as a two-spool turbofan gas turbine engine in the disclosed non-limiting embodiment, it will be understood that the concepts described herein are not limited to use with two-spool turbofans as the teachings may be applied to other types of turbine engines, including three-spool architectures.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems at various locations may alternatively or additionally be provided and the location of the several bearing systems 38 may be varied as appropriate to the application. The low speed spool 30 generally includes an inner shaft 40 that interconnects a fan 42, a low pressure compressor 44 and a low pressure turbine 46. The inner shaft 40 is connected to the fan 42 through a speed change mechanism, which in this gas turbine engine 20 is illustrated as a fan drive gear system 48 configured to drive the fan 42 at a lower speed than the low speed spool 30. The high speed spool 32 includes an outer shaft 50 that interconnects a high pressure compressor 52 and a high pressure turbine 54. A combustor 56 is arranged in the gas turbine engine 20 between the high pressure compressor 52 and the high pressure turbine 54. A mid-turbine frame 57 of the engine static structure 36 is arranged generally between the high pressure turbine 54 and the low pressure turbine 46 and may include airfoils 59 in the core flow path C for guiding the flow into the low pressure turbine 46. The mid-turbine frame 57 further supports the several bearing systems 38 in the turbine section 28. The inner shaft 40 and the outer shaft 50 are concentric and rotate via the several bearing systems 38 about the engine central longitudinal axis A, which is collinear with their longitudinal axes.

The air in the core flow path is compressed by the low pressure compressor 44 and then the high pressure compressor 52, mixed and burned with fuel in the combustor 56, and then expanded over the high pressure turbine 54 and low pressure turbine 46. The low pressure turbine 46 and the high pressure turbine 54 rotationally drive the respective low speed spool 30 and the high speed spool 32 in response to the expansion. It will be appreciated that each of the positions of the fan section 22, the compressor section 24, the combustor section 26, the turbine section 28, and the fan drive gear system 48 may be varied. For example, the fan drive gear system 48 may be located aft of the combustor section 26 or even aft of the turbine section 28, and the fan section 22 may be positioned forward or aft of the location of the fan drive gear system 48.

Various components of the gas turbine engine 20 include conduits or passageways extending through the component or a portion thereof. For example, components in the gas turbine engine 20 may include internal passages for conveying a coolant. Such components include, for example, the blades and the stators that comprise the compressor and turbine sections described above. Such components may also comprise passageways for conveying bleed air from the compressor to other areas of the gas turbine engine 20 benefiting from a source of high-pressure cooling fluid. Other components comprising conduits or passageways include the lubrication system, where lubricants are delivered from a pump to bearings and the like. Many of these various components are constructed using additive manufacturing techniques and include conduits or passageways having substantially straight or curved portions with rough internal surfaces following their manufacture.

Figure 2A:
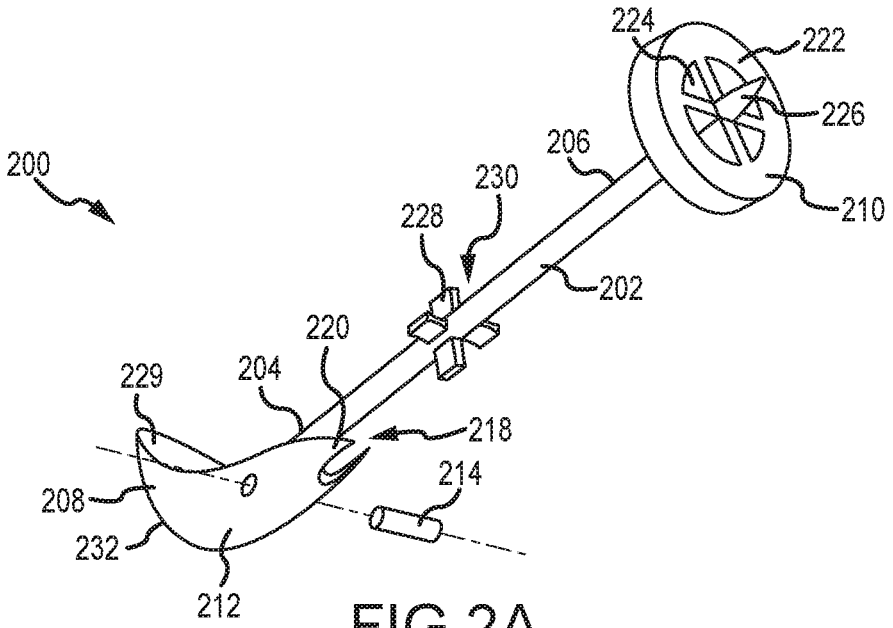
FIG. 2A is a perspective schematic view of an insert used to shield a portion of a passageway undergoing abrasive flow machining, in accordance with various embodiments.
Figure 2B:
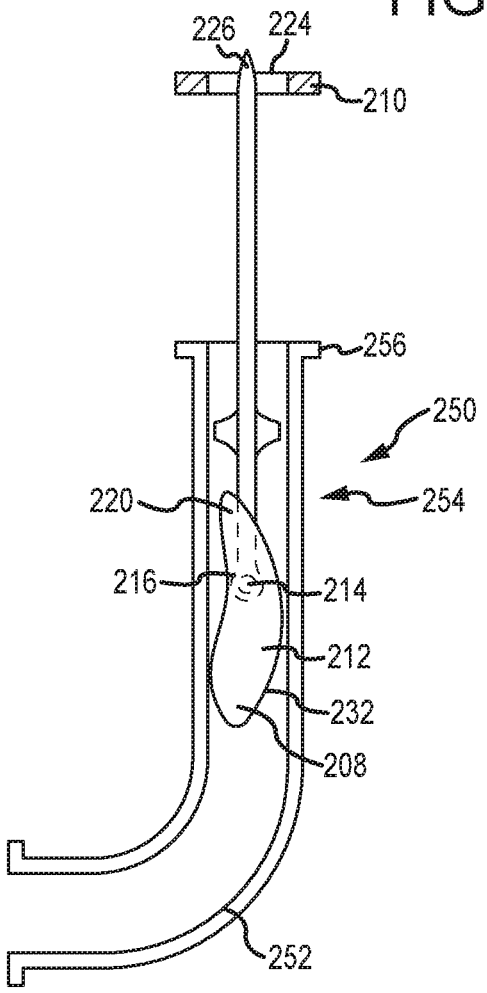
FIGS. 2B and 2C are cross sectional schematic views of the insert depicted in FIG. 2A being positioned within a passageway prior to undergoing abrasive flow machining, in accordance with various embodiments.
Figure 2C:
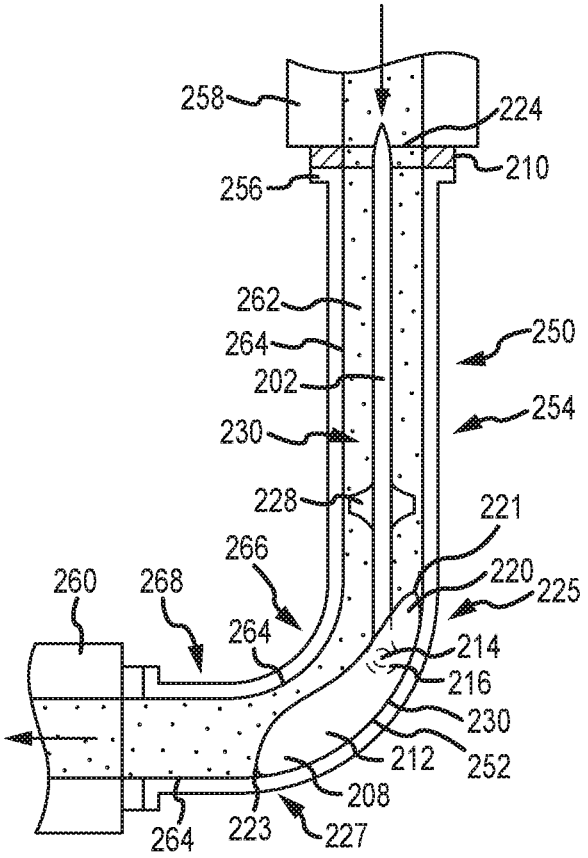

Referring now to FIGS. 2A, 2B and 2C, an insert 200 used to shield a portion of a curved passageway is illustrated in perspective, during installation and in final position, respectively, in accordance with various embodiments. In various embodiments, the insert 200 includes a shaft 202 having a first end 204 and a second end 206. A shield 208 is positioned proximate the first end 204 of the shaft 202 and an inlet 210 is positioned proximate the second end 206 of the shaft 202. In various embodiments, the shield 208 includes a shell 212 that is contoured to fit the curved contour or shape of an inner surface of a curved passageway, such as, for example, the curved passageway 250 and curved contour 252 illustrated in FIGS. 2B and 2C. In various embodiments, the shell 212 is pivotally mounted to the shaft 202 proximate the first end 204 by a pin 214 configured to extend through an aperture 216 positioned proximate the first end 204 of the shaft 202. In various embodiments, the shell 212 further includes heel portion 220 configured to wrap around a portion of the shaft 202 during installation of the insert 200 into the curved passageway 250. In various embodiments, the heel portion 220 includes a cutout portion 218 that is sized to receive a portion of the shaft 202 during installation of the insert 200 into the curved passageway 250. As illustrated in FIG. 2B, the cutout portion 218 enables the heel portion 220 of the shield 208 to be pivoted about the shaft 202 during installation of the insert into the curved passageway 250. In various embodiments, the inlet 210 comprises a disc or disc-shaped member 222 having one or more apertures 224 extending there through. In various embodiments, the insert 200 includes a nose cone 226 extending in an upstream direction from the inlet 210 and one or more wings 228 extending radially outward from the shaft 202 proximate a central portion 230 of the shaft 202 intermediate the first end 204 and the second end 206. In various embodiments, the inlet 210 is threaded on to the shaft 202 proximate the second end 206. A threaded coupling between the inlet 210 and the second end 206 of the shaft 202 enables variation in the length between the inlet 210 and the shell 212, which serves to accommodate variations in length between an inlet lip 256 (shown in FIGS. 2B and 2C) and a curved contour 252 (shown in FIGS. 2B and 2C) of the curved passageway 250. In various embodiments, the various components of the insert 200 above described may be constructed using one or more of metal, polymer, ceramic and composite materials.

Referring more specifically now to FIGS. 2B and 2C, the insert 200 above described is illustrated both during installation within the curved passageway 250 and at its final position following installation. More specifically, as illustrated in FIG. 2B, in various embodiments, the shell 212 may be pivoted such that the cutout portion 218 of the heel portion 220 extends about the shaft 202, thereby enabling the shell 212 to be inserted within a straight portion 254 (or section) of the curved passageway 250. As illustrated in FIG. 2C, the shell 212 is inserted within the curved passageway 250 until the shell 212 or, more specifically, an outer surface 232 of the shell 212, is positioned against and abuts the curved contour 252 of the curved passageway 250. In various embodiments, the inlet 210 is positioned on the shaft 202 with respect to the shell 212 such that when the shell 212 abuts the curved contour 252, the inlet 210 abuts the inlet lip 256 of the curved passageway 250, providing a seal between the inlet 210 and the inlet lip 256.

In various embodiments, the combination of the curved passageway 250 and the insert 200 positioned within the curved passageway 250 may then be installed within an abrasive flow machine, having an inlet coupling 258 and an exit coupling 260. During operation, the abrasive flow machine is configured to pump an abrasive media 262 to the inlet coupling 258 and away from the exit coupling 260 such that a continuous fluid circuit is established. In various embodiments, the abrasive media enters the inlet 210 by flowing about the nose cone 226 and through the one or more apertures 224. In various embodiments, the abrasive media 262 is then pumped through the straight portion 254 of the curved passageway 250, abrading an inner surface 264 of the curved passageway 250 adjacent the straight portion 254. The abrasive media 262 then enters a curved portion 266 (or section) of the curved passageway 250, where the abrasive media 262 is turned toward a second straight portion 268 (or section). As the abrasive media 262 is turned, the abrasive media abrades the inner surface 264 of the curved passageway 250 at those portions not covered by the shell 212, thereby reducing any tendency otherwise toward over-abrasion of the portion covered by the shell 212. The abrasive media 262 then enters the second straight portion 268, abrading the inner surface 264 of this region of the curved passageway 250 before exiting the passageway through the exit coupling 260, where the abrasive flow machine may recirculate the abrasive media 262 back to the inlet coupling 258.

In various embodiments, the shell 212 includes a first end 221 and a second end 223. In various embodiments, the first end 221 is configured for positioning proximate a first region 225 where the straight portion 254 of the curved passageway 250 merges into the curved portion 266 of the curved passageway 250 and the second end 223 is configured for positioning proximate a second region 227 where the curved portion 266 of the curved passageway 250 merges into the second straight portion 268 of the curved passageway 250. In various embodiments, the first end 221 of the shell 212 is shaped to provide a smooth transition from the inner surface 264 of the straight portion 254 of the curved passageway 250 onto an interior surface 229 of the shell 212 and the second end 223 of the shell 212 is shaped to provide a smooth transition from the interior surface 229 of the shell 212 onto the inner surface 264 of the second straight portion 268 of the curved passageway 250. In various embodiments, the curved portion 266 defines a 90-degree segment from the first region 225 to the second region 227, though segments greater than or less than 90-degrees are contemplated by the disclosure.

In various embodiments, the abrasive flow machining continues as above described until a desired smoothness is achieved. In various embodiments, the flow of abrasive media may be reversed, such that the inlet components become exit components and the exit components become inlet components. In various embodiments, the abrasive flow machining continues during a first smoothing operation as above described. The insert 200 is then removed and the curved passageway 250 is subjected to a second smoothing operation until a desired smoothness is achieved, the result being the curved contour 252 is subjected to less abrading than other surfaces within the curved passageway 250. In various embodiments, shells having differing sizes configured to shield different portions of the curved contour 252 may be employed during different smoothing operations until a desired smoothness is achieved. In various embodiments, the flow of abrasive media 262 may reciprocate back and forth, rather than be pumped in a continuous manner is a single direction.

Figure 3A:
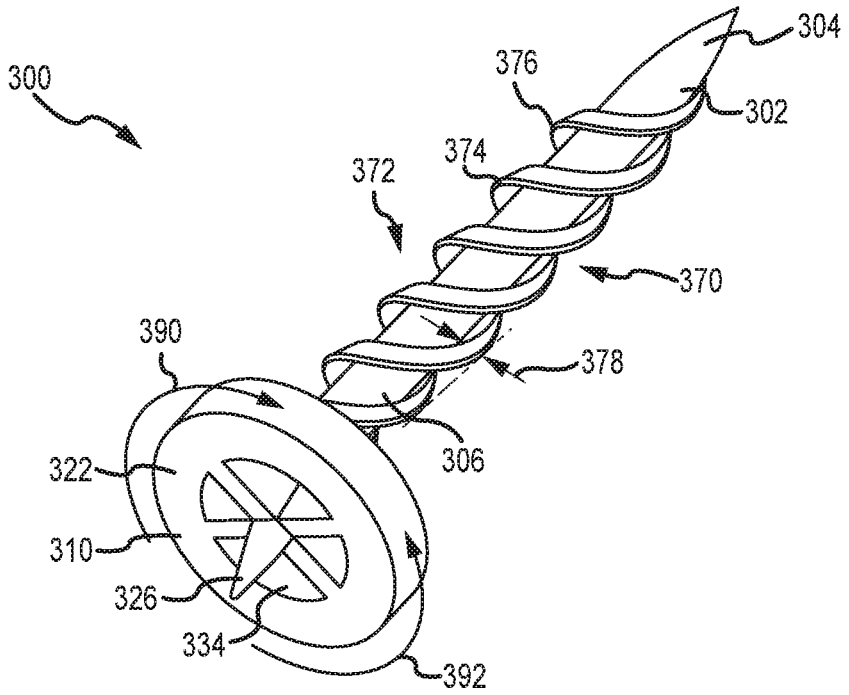
FIG. 3A is a perspective schematic view of an insert used to tailor the degree of abrasion against a wall of a passageway, in accordance with various embodiments.
Figure 3B:
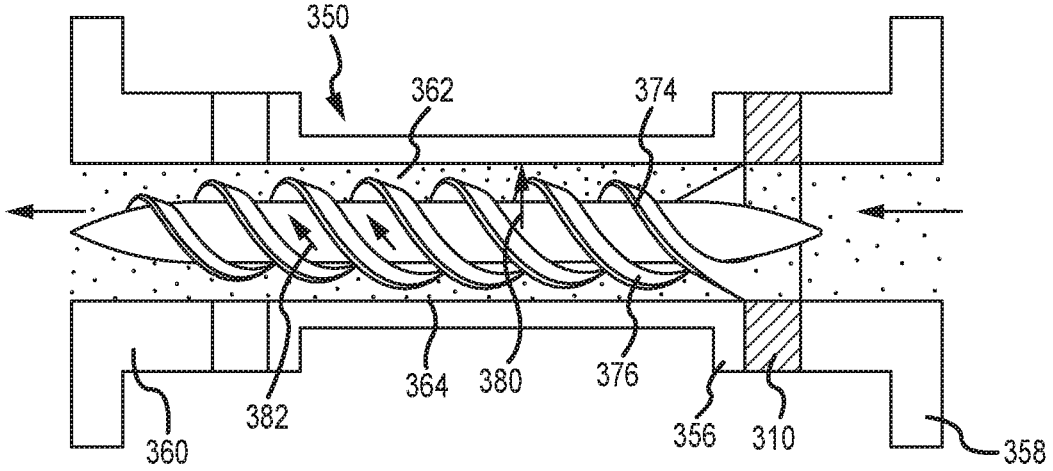
FIG. 3B is a cross sectional schematic view of the insert depicted in FIG. 3A positioned within a substantially straight passageway, in accordance with various embodiments.

Referring now to FIGS. 3A and 3B, an insert 300 used to enhance or increase the level of abrasion against an inner surface 364 of a passageway 350 is illustrated, in accordance with various embodiments. In various embodiments, the insert 300 includes a shaft 302 having a first end 304 and a second end 306. An auger 370 is positioned along a length of the shaft 302 from proximate the first end 304 to proximate the second end 306 and an inlet 310 is positioned proximate the second end 306 of the shaft 302. In various embodiments, the auger 370 includes one or more vanes 372 extending the length of the shaft 302 in helical fashion. In various embodiments, the one or more vanes comprise a first vane 374 and a second vane 376. In various embodiments, the one or more vanes are configured about the shaft 302 to cause an abrasive media 362 to flow in a spiral fashion along the length of the shaft 302 or insert 300. The configuration of the one or more vanes 372 thus imparts a radial component to the flow of the abrasive media 362 as it traverses the length of the insert 300. In various embodiments, the one or more vanes 372 define a radial distance 378 extending from a surface of the shaft 302 to a radially outermost portion of the one or more vanes 372, which may be varied to affect more of less spillage between the radially outermost portion of the vanes and the inner surface 364 of the passageway 350 which, for a constant radius duct, is situated at a constant radius 380. In various embodiments, the inlet 310 comprises a disc or disc-shaped member 322 having one or more apertures 324 extending there through. In various embodiments, the insert 300 includes a nose cone 326 extending in an upstream direction from the inlet 310. In various embodiments, the various components of the insert 300 above described may be constructed using one or more of metal, polymer, ceramic and composite materials.

Referring now to FIG. 3B, the insert 300 above described is illustrated positioned within a passageway 350. In various embodiments, the combination of the passageway 350 and the insert 300 positioned within the passageway 350 may be installed within an abrasive flow machine, having an inlet coupling 358 and an exit coupling 360. During operation, the abrasive flow machine is configured to pump an abrasive media 362 to the inlet coupling 358, through the passageway 350, and away from the exit coupling 360, such that a fluid circuit is established. The inner surface 364 of the passageway 350 is abraded to a smoothed condition as a result. In various embodiments, the abrasive media enters the inlet 310 by flowing about the nose cone 326 and through the one or more apertures 324. The abrasive media 362 then enters the auger 370, where the one or more vanes 372—e.g., the first vane 374 and the second vane 376 force the abrasive media 362 to flow downstream in the passageway 350 and impart a swirl or radial component 382 to the velocity. In various embodiments, the radial component 382 to the velocity enhances the abrasive effect of the abrasive media 362 upon the inner surface 364 of the passageway 350.

In various embodiments, the insert 300 may be rotated while positioned within the passageway 350. For example, referring again to FIG. 3A, the insert 300 may be rotated in a clockwise direction 390 (viewing axially from the inlet 310 to the second end 306) while the abrasive media 362 is pumped through the passageway 350. For the right-handed thread of the one or more vanes 372 illustrated in FIG. 3A, rotations in a clockwise direction 390 will tend to maintain the abrasive media 362 within the passageway 350 for a longer period than a counter-clockwise rotation 392, which will tend to push the abrasive material through the passageway 350, similar to operation of an Archimedes screw or pump. In other words, a rotation in a clockwise direction 390 will tend to pump the abrasive media 362 in the upstream direction, against the direction of flow, while a counter-clockwise rotation will tend to pump the abrasive media 362 in the downstream direction, in the same direction of the flow.

Figure 4:
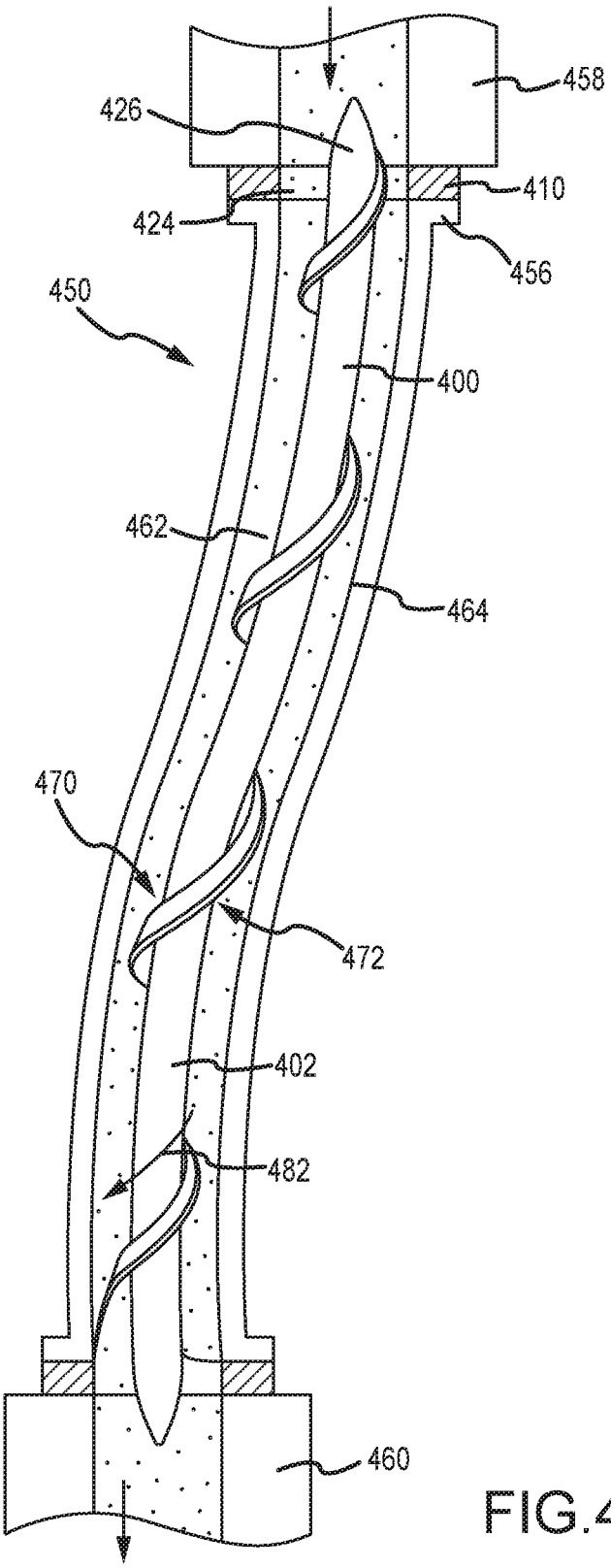
FIG. 4 is a cross sectional schematic view of an insert used to tailor the degree of abrasion against a wall of a curved passageway, in accordance with various embodiments.

Referring now to FIG. 4, an insert 400 used to enhance or increase the degree of abrasion against an inner surface 464 of a curved passageway 450 is illustrated, in accordance with various embodiments. In various embodiments, the insert 400 shares many of the features of the insert 300 above described with reference to FIGS. 3A and 3B, and so are not repeated here, though like numerals indicate like features. Briefly, in various embodiments, the insert 400 is comprised of a flexible material, such as a flexible polymer or rubber, that is capable of bending within the curved passageway 450 to fit the contour of the inner surface 464. In various embodiments, the insert 400 is capable of bending to conform to the curvature of the curved passageway 450 both while in a static state and while being rotated in either a clockwise or counter-clockwise direction. Similar to the above discussion, the insert 400 also includes an inlet 410, a shaft 402 and an auger 470 having one or more vanes 472.

In various embodiments, the combination of the curved passageway 450 and the insert 400 positioned within the curved passageway 450 may be installed within an abrasive flow machine, having an inlet coupling 458 and an exit coupling 460. During operation, the abrasive flow machine is configured to pump an abrasive media 462 to the inlet coupling 458, through the curved passageway 450, and away from the exit coupling 460, such that a continuous fluid circuit is established. The inner surface 464 of the curved passageway 450 is abraded to a smoothed condition as a result. In various embodiments, the abrasive media enters the inlet 410 by flowing about a nose cone 426 and through one or more apertures 424. The abrasive media 462 then enters the auger 470, where the one or more vanes 472 force the abrasive media 462 to flow downstream in the curved passageway 450 and impart a swirl or radial component 482 to the velocity. In various embodiments, the radial component 482 to the velocity enhances the abrasive effect of the abrasive media 462 upon the inner surface 464 of the curved passageway 450. Also similar to the foregoing, in various embodiments, the insert 400 may undergo a clockwise or counter-clockwise rotation to hasten or slow the speed at which the abrasive media 462 traverses the curved passageway 450.

Figure 5:
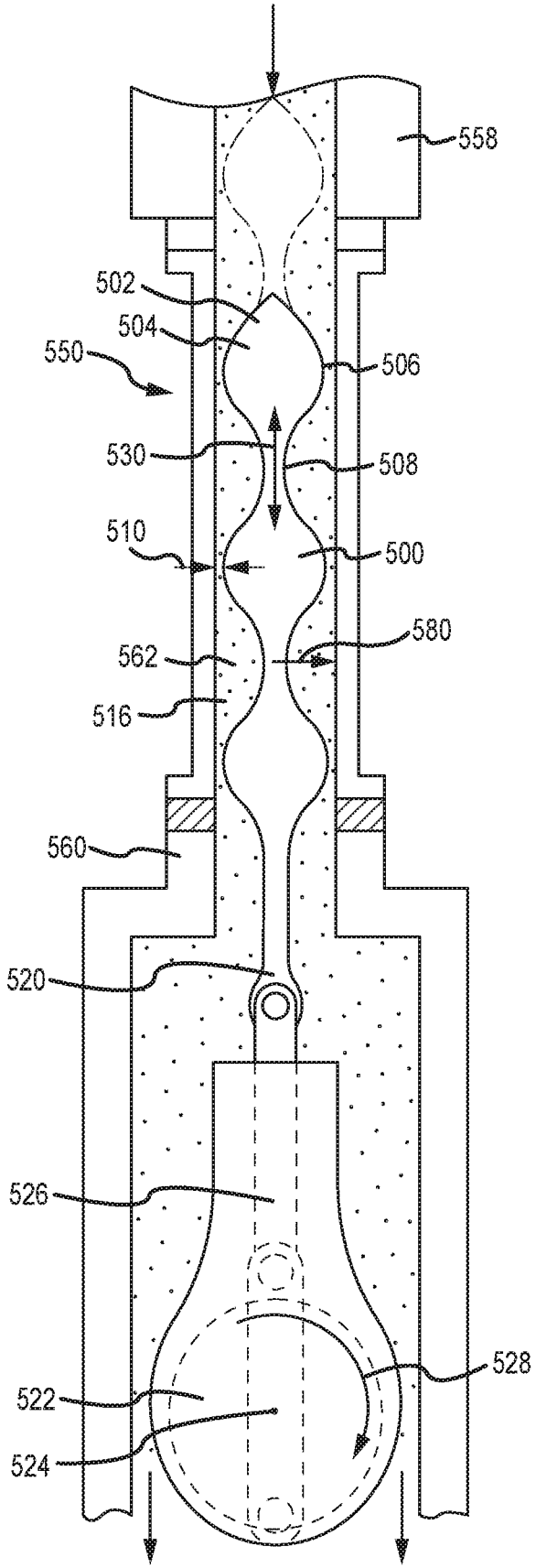
FIG. 5 is a cross sectional schematic view of a reciprocating insert used to tailor the degree of abrasion against the wall of a substantially straight passageway, in accordance with various embodiments.

Referring now to FIG. 5, an insert 500 used to enhance or increase the degree of abrasion against an inner surface 564 of a passageway 550, is illustrated in accordance with various embodiments. In various embodiments, the insert 500 includes one or more restriction members 502—e.g., bulbous portions 504—disposed along a length of the insert 500. In various embodiments, the restriction members 502 are disposed on a shaft that runs along the length of the insert 500. In various embodiments, the restriction members 502 may exhibit a sine wave characteristic along the length of the insert 500, such that a series of peaks 506 and troughs 508 are formed along the length of the insert 500 with respect to a radial dimension 580 of the inner surface 564 of the passageway 550. The peaks 506 have a portion spaced a constriction distance 510 from the inner surface 564 to form a constriction between the restriction members 502 and the inner surface 564. The troughs are spaced more toward a center of the passageway 550 and serve to form pockets 516 capable of moving an abrasive media 562 along the inner surface 564 as the insert is moved within the passageway 550.

In various embodiments, the combination of the passageway 550 and the insert 500 positioned within the passageway 550 may be installed within an abrasive flow machine, having an inlet coupling 558 and an exit coupling 560. During operation, the abrasive flow machine is configured to pump the abrasive media 562 to the inlet coupling 558, through the passageway 550, and away from the exit coupling 560, such that a fluid circuit is established. As illustrated, the insert 500 has a first end 520 coupled to a rotary mechanism, such as, for example, a crankshaft 522. During operation the crankshaft 522 rotates about an axis of rotation 524. A connecting rod 526 couples the crankshaft 522 to the first end 520 of the insert 500. As the crankshaft 522 rotates in a rotational direction 528 about the axis of rotation 524, a reciprocating motion 530 is imparted to the insert 500. The reciprocating motion 530 of the insert 500 imparts a reciprocating flow of the abrasive media 562 contained within the pockets 516 which, in various embodiments, is superimposed on the flow of abrasive media 562 pumped through the passageway 550 by the abrasive flow machine.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An insert apparatus for protecting a curved inner surface within a passageway from abrasion during an abrasive machining operation, comprising:

a shield having a shell shaped to match a curved portion of the curved inner surface of the passageway; and a shaft having a first end connected to the shell and a second end connected to a disc configured to maintain the shaft within the passageway and the shell positioned against the curved inner surface during the abrasive machining operation, the disc having a plurality of apertures extending therethrough, the disc threadedly coupled to the shaft proximate the second end of the shaft, wherein the plurality of apertures are configured to convey an abrasive media from a pump to the passageway.

2. The insert apparatus of claim 1, wherein the shield is pivotally connected to the first end of the shaft by a pin.

3. The insert apparatus of claim 2, wherein the disc is configured for positioning proximate one of an inlet and an exit of the passageway.

4. The insert apparatus of claim 2, wherein the shell is configured for insertion into a straight section of the passageway prior to being positioned against the curved inner surface.

5. The insert apparatus of claim 4, wherein the shell includes a heel configured to wrap around the shaft during insertion of the shell into the straight section of the passageway.

6. The insert apparatus of claim 5, wherein the heel includes a cutout portion configured to receive the shaft during insertion of the shell into the straight section of the passageway.

7. The insert apparatus of claim 6, further comprising one or more radially extending wings positioned on the shaft intermediate the first end and the second end.

8. The insert apparatus of claim 2, wherein the curved inner surface defines a 90-degree segment of the passageway.

* * * * *